US009305729B2

(12) United States Patent
Beauregard et al.

(10) Patent No.: US 9,305,729 B2
(45) Date of Patent: Apr. 5, 2016

(54) CAPACITIVE DRIVEN NORMAL RELAY EMULATOR USING VOLTAGE BOOST

(71) Applicants: Chad Beauregard, Chicago, IL (US); Eric Graham, Chicago, IL (US)

(72) Inventors: Chad Beauregard, Chicago, IL (US); Eric Graham, Chicago, IL (US)

(73) Assignee: LITTELFUSE, INC., Chicago, IL (US)

( * ) Notice: Subject to any disclaimer, the term of this patent is extended or adjusted under 35 U.S.C. 154(b) by 199 days.

(21) Appl. No.: 13/972,029

(22) Filed: Aug. 21, 2013

(65) Prior Publication Data

US 2015/0055267 A1 Feb. 26, 2015

(51) Int. Cl.
*H01H 47/22* (2006.01)

(52) U.S. Cl.
CPC ..... *H01H 47/22* (2013.01); *H01H 47/226* (2013.01)

(58) Field of Classification Search
CPC ... H01H 47/22; H01H 47/223; H01H 47/226; H01H 47/002
USPC ..... 361/154, 160, 187
See application file for complete search history.

(56) References Cited

U.S. PATENT DOCUMENTS 4,418,374 A * 11/1983 Callan ..... H02H 3/243 361/167
4,527,216 A * 7/1985 Stammely ..... H01H 47/226 361/156
4,679,766 A * 7/1987 Cuming ..... H01F 7/1816 137/870
RE33,825 E * 2/1992 Stammely ..... H01H 47/226 333/103
5,099,384 A * 3/1992 Chin ..... H01H 47/043 327/466
5,200,723 A * 4/1993 Fujihisa ..... H01H 51/2209 335/14
5,317,475 A * 5/1994 Siepmann ..... H01H 47/04 361/154
5,347,421 A * 9/1994 Alexanian ..... H01H 47/226 361/154
5,430,600 A 7/1995 Burns
5,740,005 A * 4/1998 Chen ..... H01H 47/325 361/160
5,957,374 A * 9/1999 Bias ..... G05D 23/1902 236/78 R
5,993,039 A * 11/1999 Crill ..... G05B 9/02 700/292
6,201,681 B1 * 3/2001 Torii ..... F01L 9/04 361/170
2007/0221627 A1 * 9/2007 Yugou ..... H01H 47/002 218/136
2007/0279828 A1 * 12/2007 Brundisini ..... A01G 25/16 361/160
2008/0079410 A1 * 4/2008 Ishii ..... G05F 1/575 323/284
2009/0128264 A1 * 5/2009 DiSalvo ..... H02H 3/338 335/6
2009/0316323 A1 * 12/2009 Knopf ..... H01H 47/226 361/156
2010/0008009 A1 * 1/2010 Cartier-Millon ..... H01F 7/081 361/156
2010/0309601 A1 * 12/2010 Shvartsman ..... H01F 7/18 361/186
2013/0327748 A1 * 12/2013 Salsich ..... B23K 9/1006 219/130.21

FOREIGN PATENT DOCUMENTS

DE 3730517 A1 3/1989
DE 10348265 A1 5/2005
FR 2854727 A3 11/2004

* cited by examiner

*Primary Examiner* — Stephen W Jackson
*Assistant Examiner* — Christopher Clark
(74) *Attorney, Agent, or Firm* — Kacvinsky Daisak Bluni PLLC

(57) ABSTRACT

A normal relay emulator is described. The normal relay emulator may include a trigger circuit configured to detect a condition on a first power rail, the first power rail having a first voltage supply level. A boost converter electrically coupled to the first power rail and configured to boost the first voltage supply level to a second, higher, voltage supply level is provided. A bi-stable relay having a first terminal and a second terminal and an actuator electrically coupled to the boost converter and communicatively coupled to the trigger circuit is also provided. The actuator may be configured to energize the bi-stable relay using the second voltage supply level such that electrical contact between the first terminal and the second terminal changes between a first state and a second state based on the trigger circuit detecting the condition.

18 Claims, 3 Drawing Sheets

CAPACITIVE DRIVEN NORMAL RELAY EMULATOR USING VOLTAGE BOOST

BACKGROUND OF THE INVENTION

1. Field of the Invention

Embodiments of the present disclosure relate generally to normal relay emulators and more particularly to normal relay emulator control circuits.

2. Discussion of Related Art

A normal relay is a relay that maintains a set position unless the relay is energized. More specifically, a normal relay will be in either the open or closed state (referred to as the "normal" state), when the coil within the relay is not energized. When the coil is energized, the relay will enter into the "non-normal" state. For example, a normally open relay provides an open circuit unless the relay is energized, in which case the relay will be closed. Similarly, a normally closed relay provides a closed circuit unless the relay is energized, in which case, the relay will be open. Once power to the coil of a normal relay is interrupted, the relay will return to the "normal" position (e.g., either open or closed). As will be appreciated, however, normal relays require a certain amount of current when energized. More particularly, a constant supply of current is required to keep the coil within the relay energized. Furthermore, the current draw of a normal relay increases with the size of the normal relay. As such, larger relays (e.g., those needing several watts of power to energize the coils) continually draw current during operation. Accordingly, a normal relay will be a constant drain on power circuitry (e.g., batteries, generators, alternators, or the like).

In order to reduce the drain on circuits using normal relays, bi-stable relays may sometimes be substituted for a normal relay. A bi-stable relay is a relay that remains in its last state when power to the relay is shut off. Said differently, a bi-stable relay can be changed from either open to closed or closed to open, by temporarily energizing the relay. The bi-stable relay will then remain in this state when power to the relay is interrupted and therefore does not draw current (or draws a small amount of current) while the relay is not changing position. As such, a bi-stable relay has a lower quiescent current requirement than does a normal relay. However, as will be appreciated, when power to the circuit including the bi-stable relay is interrupted, the bi-stable relay will remain in its last position. As a result, a bi-stable relay cannot be used to replace a normal relay in circuits where the relay must be switched to a known position when the supply of power is interrupted.

In order to address this, control circuits are available that cause a bi-stable relay to enter a known position when power to the control circuit is interrupted. These control circuits use an energy storage device (e.g., capacitor) to store energy, which is used to energize the bi-stable relay when power to the control circuit is interrupted. Accordingly, the bi-stable relay will enter a known state after the supply of power is interrupted. However, for larger bi-stable relays, a large energy storage device is required in order to be able to supply enough current to operate the bi-stable relay when power to the control circuit is interrupted. In many applications, there is insufficient space to accommodate such a large capacitor. Furthermore, the necessity of a large capacitor adds increased costs to the control circuit.

This problem is further exacerbated where the control circuit is operated from a lower voltage power supply (e.g., 12 volts, 9 volts, or the like). In such systems, charging a large capacitor to the nominal input voltage (e.g., 12 volts) will not produce enough energy to actuate the bi-stable relay and cause the bi-stable relay to change state in the absence of input power.

Thus, there is a need for a relay that returns to a known position when power is interrupted and has a low current draw during periods where the relay is not changing position. Furthermore, there is a need for such a relay that can operate on lower voltage systems and still actuate a large relay.

SUMMARY OF THE INVENTION

Exemplary embodiments of the present disclosure are directed to a normal relay emulator.

Some exemplary embodiments of the present disclosure are directed to a system for emulating a normal relay. Such exemplary system may include a trigger circuit configured to detect a condition on a first power rail, the first power rail having a first voltage supply level, a boost converter electrically coupled to the first power rail and configured to boost the first voltage supply level to a second voltage supply level, the second voltage supply level higher than the first voltage supply level, a bi-stable relay having a first terminal and a second terminal, and an actuator electrically coupled to the boost converter and communicatively coupled to the trigger circuit, the actuator configured to energize the bi-stable relay using the second voltage supply level such that electrical contact between the first terminal and the second terminal changes between a first state and a second state based on the trigger circuit detecting the condition.

Some exemplary embodiments of the present disclosure are directed to method for emulating a normal relay. Such exemplary methods may include boosting a voltage available on a first power rail from a first voltage supply level to a second voltage supply level, the second voltage supply level higher than the first voltage supply level, charging an energy storage device based on the second voltage supply level, determining whether a condition occurs on the first power rail, and causing a bi-stable relay to change to a known state based on the determination that the condition occurred, wherein the state of the bi-stable relay is changed using the energy storage device.

DESCRIPTION OF EMBODIMENTS

Figure 1:
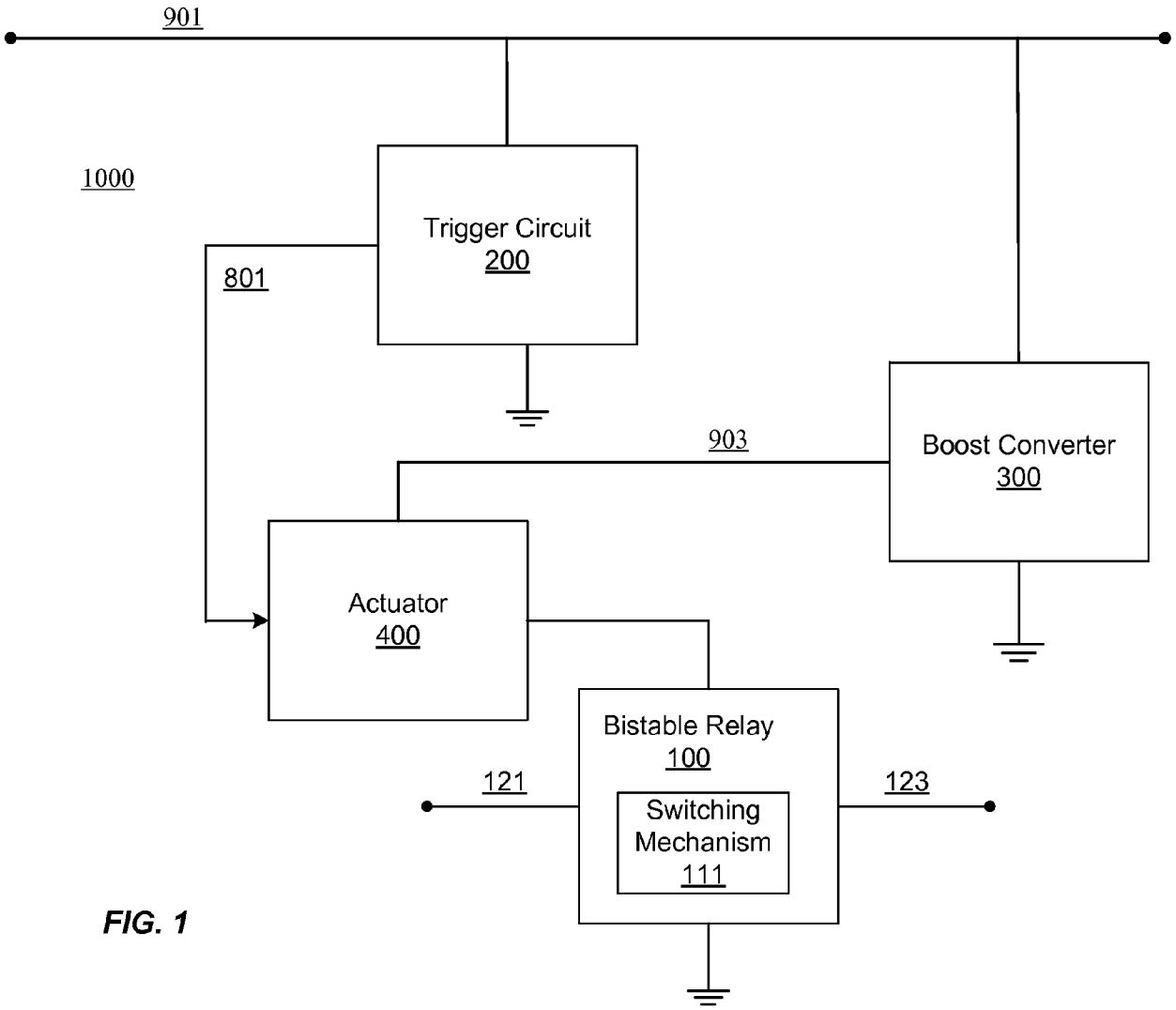
FIG. 1 is a block diagram illustrating a normal relay emulator.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Various embodiments of the present disclosure provide a normal relay emulator, which draws little (or no power) during periods when the relay is not changing state and which can operate from a low voltage power supply yet still actuate a large relay in the absence of input power. In general, various embodiments operate to boost the input voltage to a higher level, which higher level is used to operate the bi-stable relay and/or charge an energy storage device with sufficient energy to actuate the bi-stable relay in the absence of input power. In the event that input power is interrupted, the energy stored in the energy storage device is used to actuate the bi-stable relay such that the bi-stable relay enters a desired state. For example, various embodiments of the present disclosure may provide a normal relay emulator configured to operate on power supplied by an automotive style battery. As a particularly specific example, the normal relay emulator may be configured to operate as a normally open relay and may be configured to connect an auxiliary circuit (e.g., electric circuit in a trailer connected to a tractor, or the like) when a main power circuit is energized and disconnect the auxiliary circuit when the main power circuit is de-energized. The above example is given for illustrative purposes only and is not intended to be limiting.

FIG. 1 illustrates a block diagram of a normal relay emulator 1000, arranged according to at least some embodiments of the present disclosure. As depicted, the normal relay emulator 1000 includes a bi-stable relay 100, a trigger circuit 200, a boost converter 300, and an actuator 400. As will be described in greater detail below, the normal relay emulator 1000 is configured to cause the bi-stable relay 100 to "emulate" (i.e., behave like) either a normally open relay or a normally closed relay. The normal relay emulator operates on input power supplied on a first power rail 901. In some examples, a battery (e.g., a 12 volt battery, a 9 volt battery, or the like) supplies the input power. As used herein, the term "input power" generally refers to the power (having a voltage and current level) available on the first power rail 901 from a power supply (not shown). In some examples, the power supply may include a DC power source, an AC power source and a rectifier circuit, a battery, a number of batteries connected together or generally any other DC power source.

The bi-stable relay 100 may be any suitable bi-stable relay, also referred to as a "latching relay." As stated above, a bi-stable relay is a relay that remains in its last state when power to the relay is shut off. In general, the bi-stable relay 100 includes a switching mechanism 111 to open or close electrical contact between a first terminal 121 and a second terminal 123. In some examples, the bi-stable relay 100 may be formed from a solenoid operating a ratchet and cam mechanism to open or close the switching mechanism 111 contacts. As another example, the bi-stable relay 100 may be formed from opposing coils configured to hold the switching mechanism 111 contacts in place while the coils are relaxed.

As a third example, the bi-stable relay 100 may be formed from a pair of permanent magnets surrounding a ferrous plunger, disposed within the center of the coil with springs positioned to push the plunger out of the coil. During operation, when the coil is energized in one direction the magnetic field pushes the plunger away from the permanent magnets and the springs keep it in the "released" position, which may correspond to either the open or closed position depending on the positioning and connection of the contacts. When the coil is energized in the other direction, the magnetic field pulls the plunger back into range of the permanent magnets, and it is held (against the spring force) in place by the magnets. In further examples, the coil may include a center-tapped winding, which can be connected to the positive side of the voltage source. As such, each end of the coil corresponds to the open or close winding. In alternative examples, the coil may include two separate windings, one for the open and one for the close.

The normal relay emulator 1000, then, is configured to cause the switching mechanism 111 in the bi-stable relay 100 to enter either the open or closed state (depending upon the relay being emulated) when a particular condition occurs (e.g., input power on the first power rail 901 is interrupted). As used herein, input power may be interrupted when the input power falls below a specified value; when the input power falls to zero; when the input power is reduced by a specified percentage; when the input power falls below a specified value for a specified amount of time; or generally whenever there is a reduction or interrupt in the supply of power available on the first power rail 901.

As an example, assume the normal relay emulator 1000 is configured to emulate a normally open relay. During operation, when input power is supplied on the first power rail 901, the normal relay emulator 1000 will close the switching mechanism 111 of the bi-stable relay 100. Thus, electrical connection between the terminals 121 and 123 will be established. Due to the nature of a bi-stable relay, very little current will be required to hold the switching mechanism 111 in the closed position. As such, reduced power drain on the power, battery, and/or charging systems supplying the input power will be realized. In the event that power to the normal relay emulator 1000 is interrupted, the switching mechanism 111 of the bi-stable relay 100 will be opened. Thus, electrical connection between the terminals 121 and 123 will be severed. As will be appreciated, the normal relay emulator may be configured to connect a power supply to a load, where disconnection between the power supply and the load is desired if an interruption in input power to the normal relay emulator 1000 is experienced. As a particular example, terminal 121 may be connected to a battery in a tractor while terminal 123 may be connected to a load in a trailer to which the tractor is mechanically connected. Thus, the normal relay emulator 1000 may be configured to electrically connect the power supply in the tractor (e.g., battery, alternator, generator, or the like) to a load in the trailer when the tractor is on, yet, disconnect the load when the tractor is turned off. During operation, the normal relay emulator will not present a continuous drain on the power supply of the tractor due to the use of the bi-stable relay 100. As will be appreciated from the balance of the present disclosure, however, a large relay (e.g., requiring 1-15 amps of current to change state) may still be used. Said differently, the bi-stable relay 100 may be a large relay and the normal relay emulator 1000 may be configured to cause the relay to change state in the absence of input power on the first power rail 901.

For example, in some embodiments, the bi-stable relay 100 may have a 2 Ohm "Pull" coil and 1.9 Ohm "Release" coil. As such, steady state current, if the coils were left energized, would be about 6 A at 12 VDC, or 12 A at 24 VDC not accounting for losses. During operation, however, the coils may be energized with a voltage pulse (so as not to overheat the coils.) A typical voltage pulse may cause between 3 and 8 amps of current to be flow through the coil. As will be appreciated, however, since the coils are effectively an inductor, current varies versus time when the coils are energized.

As depicted, the trigger circuit 200 and the actuator 400 are communicatively coupled together via signal line 801. During operation, the trigger circuit 200 monitors the first power rail 901 to identify a selected condition that indicates an interruption of input power. When the trigger circuit 200 identifies the selected condition, it sends a signal to the actuator 400 over the signal line 801. The actuator 400 is activated by this signal and causes the switching mechanism 111 of the bi-stable relay 100 to enter the "normal" state. Said differently, when activated by the signal from the trigger circuit, the actuator supplies the correct electrical pulse (e.g., having sufficient current and duration) to the bi-stable relay 100 to cause switching mechanism 111 to either open or close. As described above, the actuator 400 is configured to cause the bi-stable relay 100 to change state in the absence of input power. More detailed example embodiments of the trigger circuit 200 and the actuator 400 are given with respect to FIGS. 2 and 3, described below.

The actuator 400 is electrically coupled to the boost converter 300 via second power rail 903. As described above, the input voltage (e.g., the voltage level available on the first power rail 901) is increased to a higher level (described in greater detail below), which higher level is used to operate the bi-stable relay and/or charge an energy storage device. The boost converter 300 is then configured to "boost" (i.e., increases) the voltage supplied on the first power rail 901 and make this increased voltage available on the second power rail 903. For example, in some embodiments, the first power rail 901 may be electrically coupled to an input power source configured to supply power having a voltage of 12 Volts. The boost converter 300 may be configured to increase the 12 Volts supplied on the first power rail 901 to 30 Volts, which is made available on the second power rail 903. Many types of boost converters are known. Boost converters may be formed from analog and/or digital circuit components. For example, a boost converter may be formed from resistors, diodes, capacitors, an inductor, and a DC-DC converter circuit (e.g., DC-DC converter NCP3064, available from ONSEMICONDUCTOR™, or the like).

Figure 2:
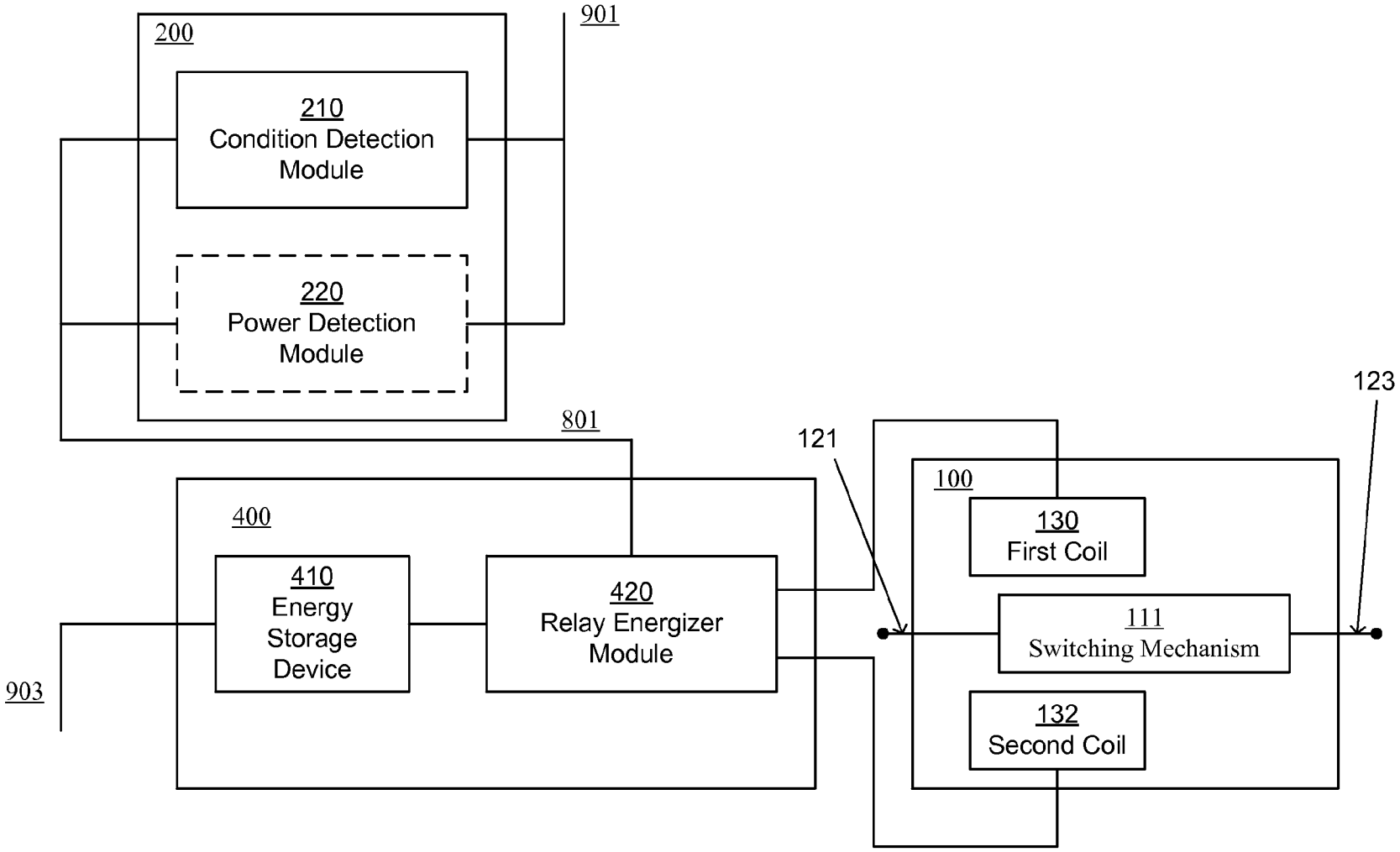
FIG. 2 is a block diagram illustrating an embodiment of a portion of a normal relay emulator.
Figure 3:
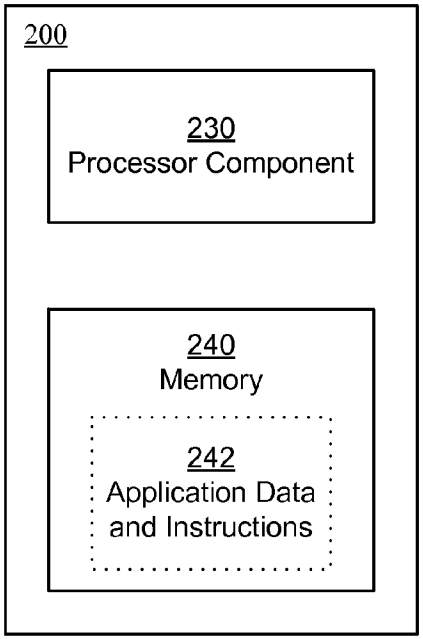
FIG. 3 is a block diagram illustrating an embodiment of a portion of a normal relay emulator.

FIGS. 2 and 3 are block diagrams of embodiments of portions of the normal relay emulator 1000 of FIG. 1. More particularly, FIGS. 2 and 3 illustrate embodiments of the trigger circuit 200, the actuator 400, and the bi-stable relay 100. It is to be appreciated, that these embodiments (like all embodiments described herein) are given for illustration only and are not intended to be limiting. Turning now more specifically to FIG. 2, as depicted, the bi-stable relay 100 is shown including a first coil 130, configured to open switching mechanism 111, and a second coil 132, configured to close switching mechanism 111. Accordingly, during operation, energizing either the first coil 130 or the second coil 132 may change the state of the bi-stable relay 100.

The trigger circuit 200 may include a condition detection module 210 and may optionally include a power detection module 220. In some examples, the modules 210 and 220 may be implemented using conventional analog, digital circuit, and/or programmable components. For example, the trigger circuit 200 may be realized from a voltage detection circuit with a fixed width pulse generator. In some examples, a programmable integrated circuit (e.g., microprocessor, or the like) may be used to implement the modules 210 and 220. For example, a microprocessor may be programmed to monitor the first power rail 901 for an interruption in power, when an interruption in power is detected, the module 210 may signal the actuator 400 via the signal line 801, as described above. This may be facilitated by using a microprocessor having a low voltage interrupt feature, wherein the low voltage interrupt is configured to detect a low voltage condition of the first power rail 901 and send a signal (e.g., the interrupt) to the actuator 400 via the signal line 801.

The trigger circuit 200 may optionally be configured to cause the normal relay to enter a known state upon detecting power on the first power rail 901. Said differently, the trigger circuit 200 may be configured to cause the bi-stable relay to enter a known state when the normal relay 1000 is initially powered on (or when power is restored after an interruption). The power detection module 220, then, may be configured to monitor the first power rail 901 and detect when power becomes available (e.g., when power raises above a specified level, when power raises above a specified level for a specified amount of time, or the like), sometimes referred to as "the threshold voltage". Upon detecting power on the first power rail 901, the trigger circuit 200 may signal the actuator 400 via the signal line 801 as described above. The power detection module 220 may be implemented using a combination of analog, digital, and or programmable logic components.

In some examples, the trigger circuit 200 may include a comparator to detect the threshold voltage, which may then trigger a one-shot circuit to pulse the actuator for the correct amount of time. With some examples, an analog comparator on-board a microcontroller chip can be used to detect the threshold voltage while a timer can be used to control the pulse width. Some examples may include a brownout voltage detector operably connected to a comparator to generate an interrupt to a microcontroller.

In some examples, the trigger circuit 200 may also monitor the voltage output from the boost converter 300 to ensure that there is enough energy stored in the energy storage device (described below) to actuate the bi-stable relay 100. With some examples, the trigger circuit 200 may be configured to not close (or open) the bi-stable relay 100 until there is enough energy stored in the energy storage device 410 to trigger the open (or close) event.

The actuator 400 may include an energy storage device 410 and a relay energizer module 420. In general, the relay energizer module 420 is configured to supply a sufficient energy pulse to the coils 130, 132 to cause the bi-stable relay 100 to change state. More particularly, the relay energizer module 420 may be configured to energize either the coil 130 or the coil 132 (depending upon whether a normally open or normally closed relay is being emulated) upon being signaled by the condition detection module 210. The relay energizer module 420 may be implemented using a combination of analog, digital, and/or programmable logic components. For example, the relay energizer module 420 may be implemented using a combination of resistors, diodes, mini-relays, BJT, IGBT, and/or MOSFET logic components.

In order to supply a sufficient energy pulse to the coils, particularly, in the absence of input power on the first power rail 901, the actuator 400 includes the energy storage device 410. In general, the energy storage device 410 may be any device capable of storing energy (e.g., a capacitor, rechargeable battery, or the like). The energy storage device 410 is then charged to the nominal voltage level available on the second power rail 903 (i.e., the boosted input voltage level). Subsequently, when the input power is interrupted, the energy stored in the energy storage device 410 is used to energize either of the coils 130 or 132. As will be appreciated, the energy stored in a capacitor may be represented by the following equation: $E=\frac{1}{2}*C*V^2$, where E is the energy in the capacitor, C is the capacitance of the capacitor, and V is the voltage to which the capacitor is charged.

In a particularly illustrative example, the first power rail 901 may be supplied by a power source having a voltage level of 12 Volts. The boost converter 300 may boost the 12 Volts to 30 Volts, which is available on the second power rail 903. The energy storage device 410 may be a capacitor having a capacitance of 2200 uFarads. Accordingly, charging the capacitor to 30 volts will result in a stored energy value of 0.99 Joules (i.e., $0.5*0.0022*30^2$). Achieving an equivalent energy value from the input voltage (i.e., 12 Volts) would require a much larger capacitor (e.g., having a capacitance of greater than 13,750 uFarads). As will be appreciated, the ability to use a smaller capacitor (e.g., due to the functionality of the boost converter 300) enables the use of a smaller capacitor, which reduces cost, size, and operational delay for the normal relay emulator 1000 as compared to conventional devices.

Turning more specifically now to FIG. 3, as depicted, the condition detection module 210 may include a processor component 230 (e.g., a microprocessor, a programmable IC, or the like) and a memory 240 (e.g., a non-transitory media, such as, for example, ROM, EEPROM, FLASH, or the like). The memory 240 may include application data and instructions 242, which include machine executable instructions, that when executed by the processor component 230 cause the processor component to execute particular functions corresponding to various embodiments described herein. For example, the application data and instructions 242 may include machine executable instruction, that when executed by the processor component 230 cause the processor component 230 to implement the behavior of the condition detection module 210 and/or the power detection module 220 described above. A particular benefit of using a programmable processor component to implement the trigger circuit 200 is that the trigger circuit 200 may be reprogrammed (e.g., by modifying the application data and instructions 242) to implement either a normally open or a normally closed relay without changing any components or the arrangement of the normal relay emulator 1000.

Figure 4:
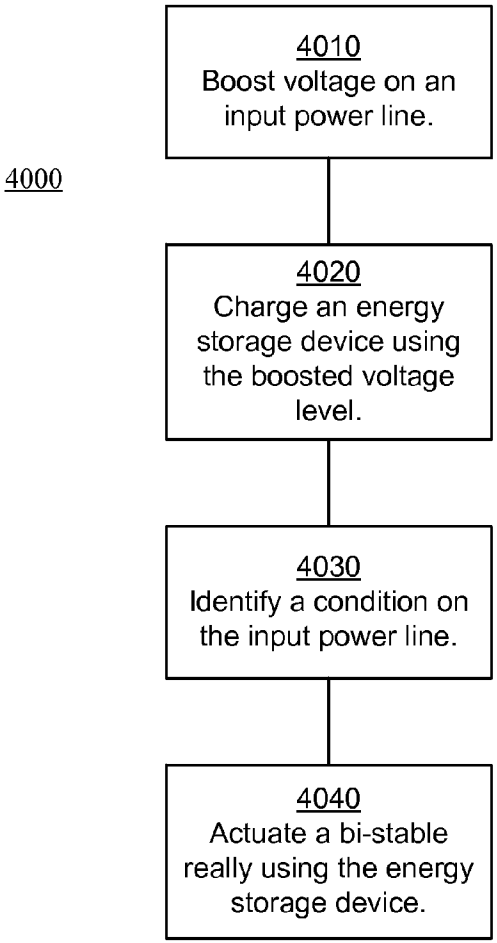
FIG. 4 is a flow chart illustrating a method of emulating a normal relay, all arranged according to at least some embodiments of the present disclosure.

FIG. 4 is a flow chart illustrating a method 4000 for emulating a normal relay. The method 4000 is described with reference to the normal relay emulator 1000. It is to be appreciated, however, that the method 4000 may be practiced using other suitable normal relay emulators. Beginning at block 4010, the boost converter 300 may boost the voltage available on the first power rail 901 to a higher voltage and make the boosted voltage available on the second power rail 903.

Continuing from block 4010 to block 4020, the energy storage device 410 may be charged using the voltage available on the second power rail 903. Continuing from block 4020 to block 4030, the condition detection module 210 may identify an interruption in input power on the first power rail 901. In some examples, the condition detection module 210 identifies that the input power has been interrupted and signals the actuator 400 to either open or close the switching mechanism 111 (e.g., via signal line 801).

Continuing from block 4030 to block 4040, the actuator 400 energizes the bi-stable relay 100 using the energy stored in the energy storage device 410 in order to either open or close the switch.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A normal relay emulator comprising:

a trigger circuit configured to detect a condition on a first power rail, the first power rail having a first voltage supply level;

a boost converter electrically coupled to the first power rail and configured to boost the first voltage supply level to a second voltage supply level, the second voltage supply level higher than the first voltage supply level;

a bi-stable relay having a first terminal and a second terminal; and an actuator electrically coupled to the boost converter and communicatively coupled to the trigger circuit, the actuator configured to energize the bi-stable relay using the second voltage supply level such that electrical contact between the first terminal and the second terminal changes between a first state and a second state based on the trigger circuit detecting the condition, wherein the trigger circuit monitors the first power rail to determine when a voltage of the first power rail is restored and exceeds a threshold voltage after interruption of the first power rail providing the first voltage supply voltage, the trigger circuit causing the bi-stable relay to enter a known state upon determining the voltage of the first power rail is restored and exceeds the threshold, the trigger circuit to determine a voltage output of the boost converter, the trigger circuit to prevent the actuator from energizing the bi-stable relay when the voltage output of the boost converter is determined to be insufficient.

2. The normal relay emulator of claim 1, wherein the condition indicates an interruption in input power on the first power rail.

3. The normal relay emulator of claim 2, the actuator comprising:

an energy storage device configured to store a quantity of energy based at least in part on the second voltage supply level; and a relay energizer module configured to energize the bi-stable relay using the quantity of energy stored in the energy storage device.

4. The normal relay emulator of claim 3, wherein the energy storage device is a capacitor.

5. The normal relay emulator of claim 4, wherein the bi-stable relay includes a coil and the relay energizer module is configured to discharge the capacitor across the coil.

6. The normal relay emulator of claim 1, wherein the first state corresponds to electrical connection between the first terminal and the second terminal.

7. The normal relay emulator of claim 6, wherein the actuator is configured to change the bi-stable relay from the first state to the second state based on the trigger circuit detecting the condition.

8. The normal relay emulator of claim 6, wherein the actuator is configured to change the bi-stable relay from the second state to the first state based on the trigger circuit detecting the condition.

9. The normal relay emulator of claim 1, wherein the condition is that the first voltage supply level drops below a specified minimum voltage level.

10. A system for emulating a normal relay comprising:

a first power rail;

a power supply electrically coupled to the first power rail, the power supply configured to output a first voltage supply level to the first power rail;

a boost converter electrically coupled to the first power rail and configured to boost the first voltage supply level to a second voltage supply level, the second voltage supply level higher than the first voltage supply level;

a trigger circuit configured to detect a condition on the first power rail;

a bi-stable relay having a first terminal and a second terminal; and an actuator electrically coupled to the boost converter and communicatively coupled to the trigger circuit, the actuator configured to energize the bi-stable relay using the second voltage supply level such that electrical contact between the first terminal and the second terminal changes between a first state and a second state based on the trigger circuit detecting the condition, wherein the trigger circuit monitors the first power rail to determine when a voltage of the first power rail is restored and exceeds a threshold voltage after interruption of the first power rail providing the first voltage supply voltage, the trigger circuit causing the bi-stable relay to enter a known state upon determining the voltage of the first power rail is restored and exceeds the threshold, the trigger circuit to determine a voltage output of the boost converter, the trigger circuit to prevent the actuator from energizing the bi-stable relay when the voltage output of the boost converter is determined to be insufficient.

11. The system of claim 10, wherein the condition indicates an interruption in input power on the first power rail.

12. The system of claim 11, the actuator comprising:

an energy storage device configured to store a quantity of energy based at least in part on the second voltage supply level; and a relay energizer module configured to energize the bi-stable relay using the quantity of energy stored in the energy storage device.

13. The system of claim 12, wherein the energy storage device is a capacitor.

14. The system of claim 13, wherein the bi-stable relay includes a coil and the relay energizer module is configured to discharge the capacitor across the coil.

15. The system of claim 10, wherein the actuator is configured change the bi-stable relay from the first state to the second state based on the trigger circuit detecting the condition.

16. The system of claim 10, wherein the actuator is configured to change the bi-stable relay from the second state to the first state based on the trigger circuit detecting the condition.

17. The system of claim 10, wherein the condition is that the first voltage supply level drops below a specified minimum voltage level.

18. The normal relay emulator of claim 1, wherein the trigger circuit comprises a microprocessor.

* * * * *